United States Patent [19]

Ferrary et al.

[11] 4,045,334

[45] Aug. 30, 1977

[54] METHOD AND APPARATUS FOR SEPARATING LIGHTER AND HEAVIER PORTIONS OF THRESHED TOBACCO

[75] Inventors: Ferdinand F. Ferrary, Richmond, Va.; Herman T. Johnson, Pittsboro, N.C.; John H. Hudson, Richmond, Va.

[73] Assignee: AMF Incorporated, White Plains, N.Y.

[21] Appl. No.: 691,260

[22] Filed: May 28, 1976

[51] Int. Cl.[2] ..... B07B 4/00

[52] U.S. Cl. ..... 209/141; 209/153; 209/154

[58] Field of Search ..... 209/133, 144, 136–139 R, 209/140, 141, 153, 154, 143; 131/146

[56] References Cited

U.S. PATENT DOCUMENTS

| | | | |
|---|---|---|---|
| 1,863,666 | 6/1932 | Lorenz | 209/133 |
| 3,010,576 | 11/1961 | Harte et al. | 209/35 |
| 3,265,209 | 8/1966 | Wochnowski et al. | 209/136 |
| 3,655,043 | 4/1972 | Wochnowski et al. | 209/138 |

*Primary Examiner*—Frank W. Lutter
*Assistant Examiner*—Ralph J. Hill
*Attorney, Agent, or Firm*—George W. Price; Charles J. Worth

[57] ABSTRACT

The method and apparatus for separating lighter and heavier portions of threshed tobacco by creating two adjacent vortices circulating in opposite directions the turbulence of which separates the threshed tobacco; the vortices coacting to form rising column of high velocity air for carrying off lighter portions of tobacco while heavier portions of tobacco drop to a pneumatic take-off.

20 Claims, 3 Drawing Figures

METHOD AND APPARATUS FOR SEPARATING LIGHTER AND HEAVIER PORTIONS OF THRESHED TOBACCO

This invention generally relates to an improved method of pneumatic separation of lighter and heavier leaf materials and the apparatus therefor.

It has been found that pneumatic separation is particularly adapted for separating lighter from heavier tobacco leaf portions or free lamina from stem-attached-lamina or other unwanted particles of threshed tobacco leaf as shown and described in U.S. Pat. No. 3,593,851 which was granted July 20, 1971 to J. W. Davidson. Improved pneumatic separators with substantially closed loop systems or recirculating pneumatic separators are old in the art as taught by U.S. Pat. No. 3,608,716 which was granted Sept. 28, 1971 to Rowell et al. Even the further improvement of admitting inlet air through opposite sides of the separation chamber is not new as shown by U.S. Pat. No. 3,655,043 which was granted Apr. 11, 1972 to Wochnowski et al.

It should be readily understood that pneumatic separators available prior to this time utilized high volume air flow to form a rising column of non-turbulent air essentially filling the separation chamber and being passed through a flow of threshed tobacco to act as a carrier and remove the lighter portions thereof; the heavier portions dropping to the bottom of the chamber from where they were removed by mechanical means. Such separators are high energy separators.

The present invention does not contemplate radical changes in construction of presently available separators, except that pneumatic means now can be utilized for taking off or removing the heavier portions of tobacco instead of mechanical means as was heretofore required. The present invention, based on a completely novel approach, does contemplate creation of entirely different air flows with controlled turbulence, and controlled pressures or pressure zones in the separation chamber. In this manner more efficient pneumatic separation is accomplished by a low energy pneumatic separator. It has been found that a separator heretofore available, as an example, required a 40 H.P. motor driven blower to provide air flows of approximately 15,000 C.F.M. for the equivalent separation accomplished by a separator utilizing the present invention having a 20 H.P. motor driven blower creating air flows of 7,000 to 9,000 C.F.M. through the separation chamber.

Accordingly, an object of the present invention is to derive more efficient pneumatic separation of lighter and heavier materials such as threshed tobacco.

Another object of the present invention is to utilize novel air flows in a controlled pressure separation chamber for separating lighter and heavier portions of threshed tobacco.

And another object of the present invention is to provide a pneumatic separator with pneumatic means for removing the separated heavier tobacco portions.

The foregoing and other objects and advantages of the invention will appear more fully hereinafter from a consideration of the detailed description which follows, taken together with the accompanying drawings wherein a single embodiment of the invention is illustrated by way of example. It is to be expressly understood, however, that the drawings are for illustration purposes only and are not to be construed as defining the limits of the invention.

Figure 1:
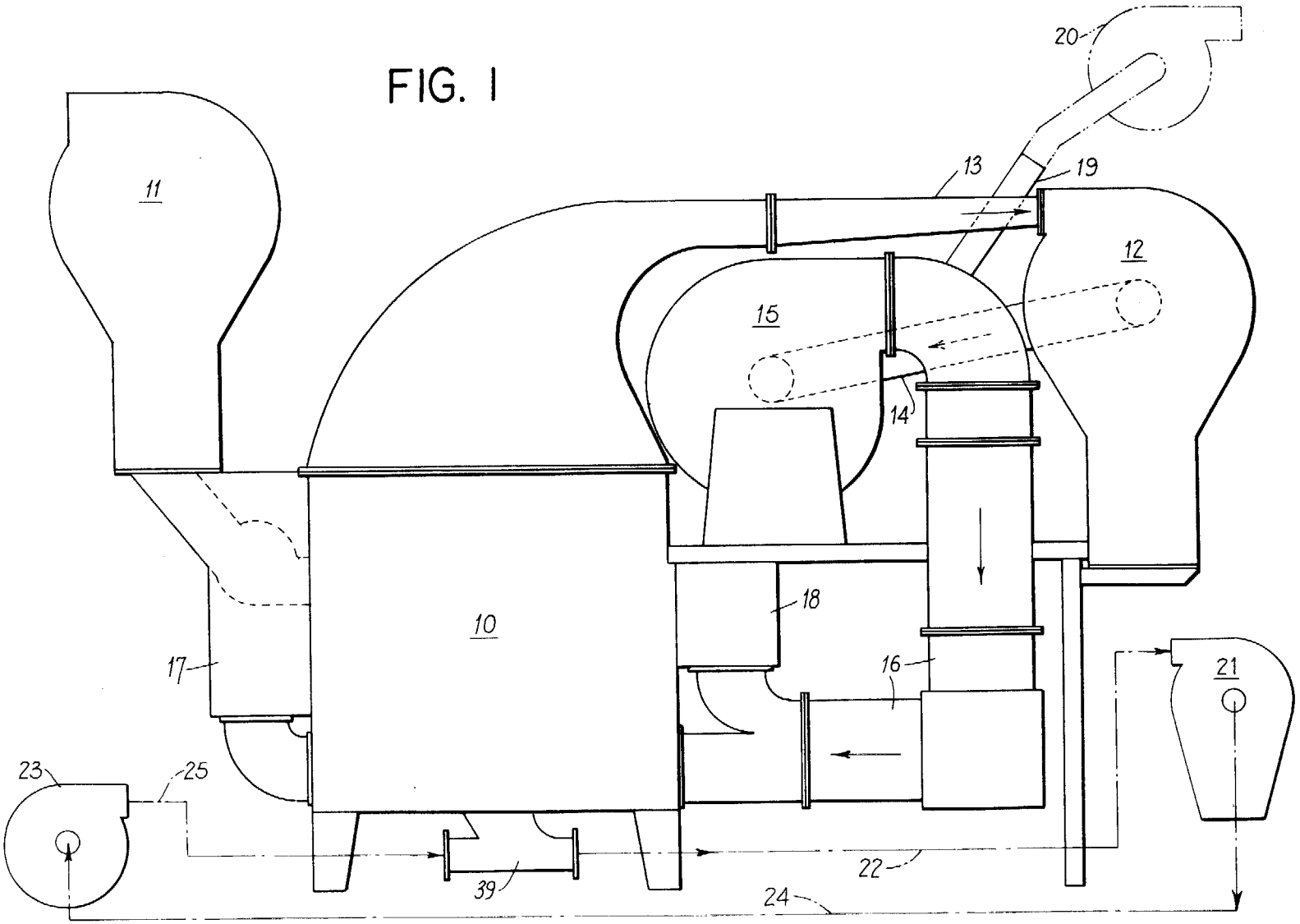
FIG. 1 is an elevational view diagrammatically illustrating a recirculating pneumatic separator system in accordance with the present invention.
Figure 2:
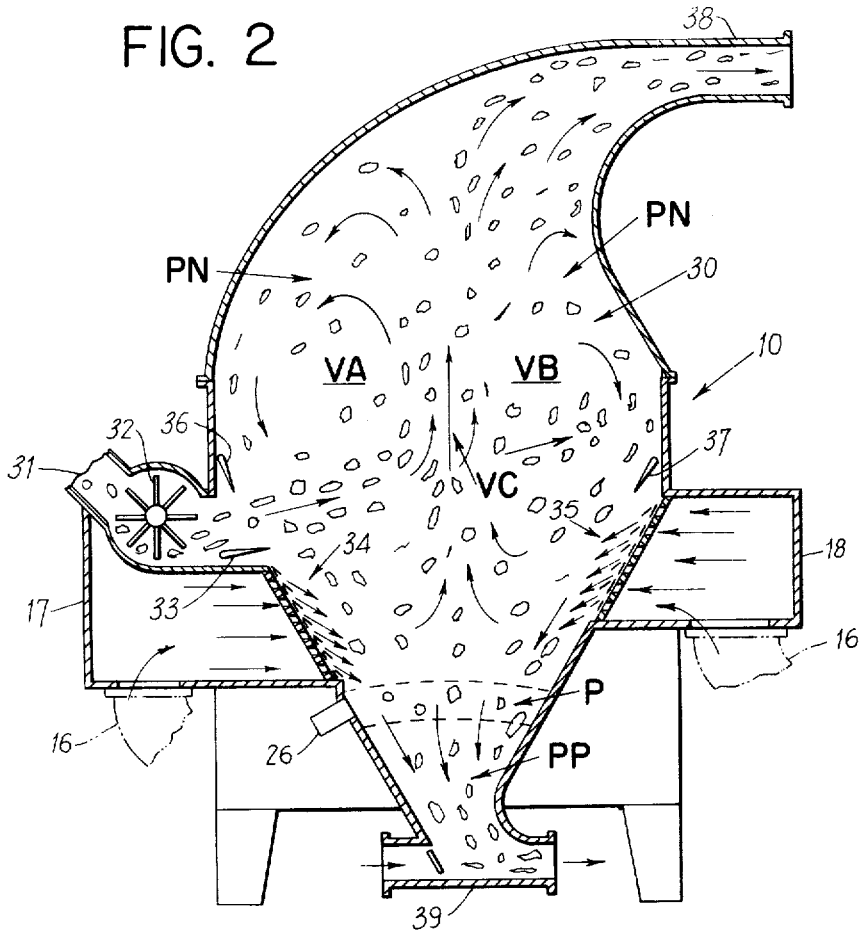
FIG. 2 is a sectional view through the pneumatic separator of FIG. 1.

Referring now to the drawings and particularly to FIGS. 1 and 2 a thresher (not shown) provides air carried threshed tobacco leaves to an unloader 11 which removes the carrier air and delivers the threshed tobacco leaves to the inlet 31 of the separation chamber 30 of a pneumatic separator 10. The upper end of the separator 10 is suitably shaped to provide a dishcarge stack 38 for the lighter portions of the threshed tobacco which are separated from the heavier portions in the chamber 30. The bottom or lower end of the separator 10 is provided with a venturi or pneumatic take-off 39 for such heavier tobacco portions.

The discharge stack 38 is appropriately connected by a duct 13 to the intake of an unloader 12 which removes the carrier air from the lighter portions of the threshed tobacco and, through a duct 14, delivers this carrier air to the intake of a motor driven blower 15. The blower 15 is connected by suitable ducting 16 to a pair of manifolds or plenums 17 and 18 disposed on opposite sides of the separator 10 for supplying air to the chamber 30, as will be further described in more detail. The discharge of the blower 15 in most instances will require a bleed-off 19 depending primarily upon the amount of air leakage and, possibly, a bleed-off blower as indicated at 20 in FIG. 1. It should be noted that the chamber 30 of the separator 10 with the unloader 12, the blower 15, the manifolds 17 and 18, and the connecting ducts 13, 14 and 16 form an essentially closed recirculating air loop or system.

The venturi 39, providing the pneumatic takeoff is connected by ducting 22 to an unloader 21 which removes the carrier air from the separated heavier portions of threshed tobacco and, through ducting 24, returns the air to a motor driven blower 23. The blower 23 is connected by a duct 25 to supply air back to the venturi 39. Therefore, the venturi 39 with the unloader 21, blower 23 and ducts 22, 24 and 25 forms a second essentially closed loop or air recirculation system. The venturi 39, as diagrammatically shown, is provided with flow control means such as an adjustable vane which is suitably positioned or set to control the air flow from duct 25 to duct 22 and thereby control the pressure at the bottom of the separator 10 which, as desired, substantially eliminates air flow between the bottom of the chamber 30 and the second recirculation system. Accordingly, the heavier portions of tobacco fall through substantially still air into the venturi 39.

The air manifolds 17 and 18 are provided with suitable louvred and shuttered chamber inlets 34 and 35, respectively, which control the direction of vertical deflection and quantity of air into the chamber 30 which, in accordance with the present invention, are suitably balanced, as required, to form two vortices VA and VB; the upwardly moving adjacent flow portions of which cojoin and form a jet stream or high velocity rising air column VC. To insure proper circulation an adjustable vane 36 is provided immediately above the tobacco inlet 31 to direct the downwardly flow of air of vortex VA and tobacco portions carried thereby away from the chamber wall, and a corresponding adjustable vane 37 is provided immediately above the air inlet 35 for the downwardly flow of vortex VB.

The upper portion of the chamber 30 or the discharge stack 38 is suitably shaped to induce the jet stream or rising air column VC, above vortices VA and VB, to progressively increase in speed in the direction of discharge to the duct 13 and carry off the lighter portions of the threshed tobacco while the heavier portions of tobacco essentially carried by vortices VA and VB tend to drop towards the bottom of the chamber 30 to the ventrui take-off 39.

The tobacco inlet 31 is provided with a winnower 32 for mechanically propelling a flow of threshed tobacco across the chamber 30 into the lower portions of the vortices VA and VB, and an adjustable vane 33 to adjust or correct the direction or vertical deflection of such flow. The controlled turbulence or the vortices VA and VB in the chamber 30 tends to separate the various portions of threshed tobacco, and the formed jet stream VC carries the lighter portions of tobacco off through the discharge stack 38 while the heavier portions of the tobacco tend to drop down to the venturi take-off 39.

Figure 3:
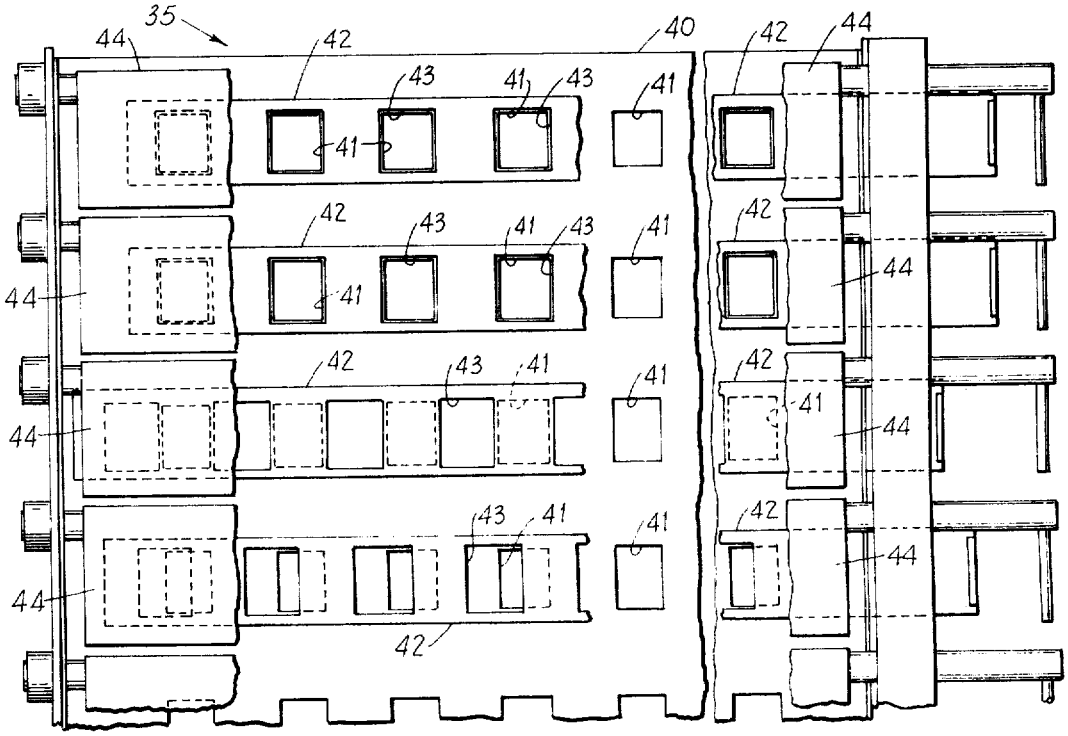
FIG. 3 is an enlarged fragmentary elevational view of an air inlet of the separation chamber of FIG. 2.

Referring now to FIG. 3, the air inlets 34 and 35 are of common construction and, therefore, only air inlet 35 will be described in detail. The inlet 35 is provided with a plate 40 having a plurality of vertically spaced horizontal rows of equally spaced openings or ports 41; the number of such rows and such ports being determined by the overall opening from the manifold or plenum 18 to the chamber 30 and the size of the ports 41 to provide maximum air flow therethrough. A manually operable or positionable slide valve or plate 42 is provided for each row of ports 41 and has a spaced series of openings or ports 43, the size and spacing of which coincides with the size and spacing of the ports 41. As shown in FIG. 3, the upper two valves 42 are in the fully open position permitting maximum air flow through the upper two rows of ports 41. The third valve 42 is in its fully closed position blocking flow through the ports 41 controlled thereby while the lowermost valve 42 is in an intermediate positon.

A manually positionable or adjustable vane 44 is disposed inwardly from the plate 40 in the chamber 30 for each row of ports 41 and the associated valve 42 to control the entrance angle or vertical deflection of the air from the plenum or manifold 18 into the chamber 30. Any suitable friction or manually operable means for retaining each of the valves 42 and vanes 44 in position obviously must be provided.

To essentially isolate or prevent interaction between the air flows and pressures in the chamber 30 and flows and pressure resulting from the venturi 39, a suitable manually adjustable bidirectional bleed or balancing valve 26 may be provided in the wall of the separator 10 between the inlets 34 and 35, and the venturi 39. Accordingly, the inside of the separator 10 is essentially divided into three pressure zones, PN in the separator chamber 30 between the air inlets 34 and 35, and the stack 38; PP at the bottom of the separator under the influence of the venturi 39; and P between the zones PN and PP, and controlled by the valve 26. Thus, the two essentially closed air circulating systems are isolated from interacting with each other.

As a final adjustment, or to insure isolation or interaction is prevented between air flows and pressures in the chamber 30 and flows and pressures resulting from the venutri 39, which can be viewed as being the two essentially closed loop air recirculating systems, any suitable manually adjustable bidirectional bleed or balancing valve 26 may be provided in the wall of the separator 10 between the venturi 39 and inlets 34 and 35. The valve 26 may be of any well known construction and may, as an example, correspond to a single row of ports 41 and a single valve member 42 of inlet 35. The valve may be adjustable, as desired, to any position from fully closed to fully open providing maximum flow and/or pressure between zone P of the chamber 30 and the atmosphere surrounding the separator 10.

Accordingly, the separator chamber 30 is essentially divided into three pressure zones, zone PN being the separation and discharge area extending from inlets 34 and 35 to the discharge 38, zone PP being at the bottom of the chamber under the influence of the venturi 39, and buffer zone P between zones PN and PP and which is controlled by the valve 26.

It has been found to be good practice to maintain the main portion, zone PN, of the separator chamber slightly negative, as an example, from $-0.25$ to $-0.75$ in. $H_2O$ which will assist in preventing dust leakage and keep access doors closed by atmospheric pressure. This can be accomplished by appropriate balance of fan speeds or flow velocities in the closed loop system which includes zone PN and appropriate bleed-off at 19 with or without blower 20, as required. If this loop should require make-up air or removal of excess air then bleed valve 26 and zone P will provide ambient air and a pressure drop corresponding to the negative pressure desired without disturbing the desired no flow condition in the zone PP, or to act as a blow-off.

It is good practice to maintain line velocities in the venturi loop at 4000 F.P.M. or higher. With such velocities, the venturi 39 is appropriately adjusted to provide a pressure drop which will result in a no flow condition in zone PN. If because of a partial blockage in the venturi 39 or a small error in adjustment there is some flow in the zone PN, the bleed valve 26 will act as a compensator and the zone P will provide a buffer to prevent such flow from effecting flow in the lower end of zone PN or the vortices.

In view of the foregoing, it should be readily understood that for separating threshed tobacco, the present invention contemplates the novel method and apparatus for use of turbulence, controlled pressures, higher velocities of smaller quantities of air for carrying off lighter portions of threshed tobacco with pneumatic take-off of heavier portions of threshed tobacco as compared to larger volumes of nonturbulent lower velocity air in separators heretofore available which required mechanical means for removing the heavier portions of threshed tobacco.

Although but a single embodiment of the invention has been illustrated and described in detail, it is to be expressly understood that the invention is not limited thereto. Various changes may also be made in the design and arrangement of the parts without departing from the spirit and scope of the invention as the same will now be understood by those skilled in the art.

We claim:

1. A method of separating lighter and heavier portions of threshed tobacco comprising the steps of:

providing a separator chamber having a discharge at its top for such lighter portions and a take-off at its bottom for such heavier portions;

providing air inlets in opposite sides of the separator chamber and providing flows of inlet air therethrough;

controlling the quantity and vertical deflection of each of the inlet air flows thereby creating two vortices adjacent to one another in the separator chamber each in a circulatory path in a direction opposite to the direction of the other of the vortices with the adjacent portions of said vortices coacting to provide a high velocity rising air column to the discharge of the separator chamber;

providing a flow of threshed tobacco into the lower portions of both vortices in the separator chamber;

separating the threshed tobacco by the turbulence of said vortices; and carrying the lighter portions of threshed tobacco to the discharge of the separator chamber by said high velocity rising air column while permitting the heavier portions to drop to the take-off.

2. The method of separating lighter and heavier portions of threshed tobacco in accordance with claim 1, and further comprising the step of:

pneumatically removing the heavier portions of threshed tobacco at the take-off.

3. The method of separating lighter and heavier portions of threshed tobacco in accordance with claim 2, and further comprising the steps of:

providing a venturi at the take-off for pneumatically removing the heavier portions of threshed tobacco; and adjusting the venturi to substantially eliminate air flow between the bottom of the separator chamber and the venturi.

4. The method of separating lighter and heavier portions of threshed tobacco in accordance with claim 3, and further comprising the steps of:

connecting the discharge to the air inlets of the separator chamber thereby forming a substantially closed loop air recirculating system; and removing the lighter portions of threshed tobacco from the air flow in the system after leaving the separator chamber discharge.

5. The method of separating lighter and heavier portions of threshed tobacco in accordance with claim 4, and further comprsing the step of:

bleeding off a portion of the recirculating air from the air recirculating system after removing the lighter portions of threshed tobacco.

6. The method of separating lighter and heavier portions of threshed tobacco in accordance with claim 3, and further comprising the steps of:

connecting the inlet and outlet of the venturi together thereby forming a substantially closed loop air recirculating system; and removing the heavier portions of threshed tobacco from the air flow in the loop before the recirculating air returns to the venturi.

7. The method of separating lighter and heavier portions of threshed tobacco in accordance with claim 6, and further comprising the steps of:

connecting the discharge to the air inlets of the separator chamber thereby forming another substantially closed loop air recirculating system; and removing the lighter portions of threshed tobacco from the air flow in the other system after leaving the separator chamber discharge.

8. The method of separating lighter and heavier portions of threshed tobacco in accordance with claim 7, and further comprising the step of:

bleeding off a portion of the recirculating air from the other air recirculating system after removing the lighter portions of threshed tobacco.

9. The method of separating lighter and heavier portions of threshed tobacco in accordance with claim 6, and further comprising the step of:

selectively connecting the separating chamber between the air inlets and the takeoff to surrounding atmosphere to isolate each of the air recirculating systems from the other.

10. The method of separating lighter and heavier portions of threshed tobacco in accordance with claim 9, and further comprising the step of:

bleeding off a portion of the recirculating air from the other air recirculating system after removing the lighter portions of threshed tobacco.

11. Apparatus for separating lighter and heavier portions of threshed tobacco, comprising:

a separator defining a separator chamber having a dishcharge at the top thereof for lighter portions of threshed tobacco, and a pair of air inlets each at one side of the chamber opposite from the other;

each of said inlets having means for controlling the amount and vertical deflection of the air flow therethrough creating two oppositely circulating vortices adjacent to one another in said chamber providing turbulence for separating portions of threshed tobacco and coacting to form a high velocity rising column of air carrying lighter portions of threshed tobacco to said discharge while heavier portions of threshed tobacco are permitted to drop to the bottom of said chamber;

means for propelling a flow of threshed tobacco into the lower portions of the two vortices; and a venturi communicating with the bottom of said chamber and removing the heavier portions of tobacco therefrom.

12. Apparatus for separating lighter and heavier portions of threshed tobacco in accordance with claim 11, and each of said inlets comprising:

a plate having a plurality of vertically spaced rows of ports disposed horizontally and equally spaced from one another;

a plurality of slide valves each manually operable between fully open and closed positions and controlling the amount of flow through a different row of said ports; and a plurality vanes each manually positionable independent of the others and controlling the vertical deflection of air flow through a different row of said ports.

13. Apparatus for separating lighter and heavier portions of threshed tobacco in accordance with claim 12, and said venturi being adjustable and set to eliminate air flow between the bottom of said chamber and said venturi.

14. Apparatus for separating lighter and heavier portions of threshed tobacco in accordance with claim 13, further comprising:

unloader means for removing lighter portions of tobacco from the air flow from said discharge and blower means connected in series between said discharge and air inlets and with said defined chamber forming a substantially closed loop air recirculating system.

15. Apparatus for separating lighter and heavier portions of threshed tobacco in accordance with claim 14, and:

said blower having a discharge connected to said air inlets; and means for bleeding off air from said discharge.

16. Apparatus for separating lighter and heavier portions of threshed tobacco in accordance with claim 13, further comprising:

unloader means for removing heavier portions of threshed tobacco from the air flow from the venturi outlet and blower means connected in series between the outlet and inlet of said venturi and with said venturi forming a substantially closed loop air recirculating system.

17. Apparatus for separating lighter and heavier portions of threshed tobacco in accordance with claim 16, further comprising:

unloader means for removing lighter portions of tobacco from the air flow from said discharge and blower means connected in series between said discharge and air inlets and with said defined chamber forming another substantially closed loop air recirculating system.

18. Apparatus for separating lighter and heavier portions of threshed tobacco in accordance with claim 17, and:

said blower of said other system having a discharge connected to said air inlets, and means for bleeding off air from said discharge.

19. Apparatus for separating lighter and heavier portions of threshed tobacco in accordance with claim 17, and:

controlled valve means for selectively connecting said defined chamber between said air inlets and said venturi to atmosphere surrounding said separator thereby isolating each of said systems from the other.

20. Apparatus for separating lighter and heavier portions of threshed tobacco in accordance with claim 19, and:

said blower of said other system having a discharge connected to said air inlets, and means for bleeding off air from said discharge.

* * * * *